US007015887B2

(12) United States Patent
Oda et al.

(10) Patent No.: US 7,015,887 B2
(45) **Date of Patent: *Mar. 21, 2006**

(54) DRIVING CIRCUIT AND DRIVING METHOD FOR LCD

(75) Inventors: Kyoichiro Oda, Tokyo (JP); Akimasa Yuuki, Tokyo (JP); Shin Tahata, Tokyo (JP); Toshio Tobita, Tokyo (JP); Shiro Miyake, Kikuchi-gun (JP); Kazuhiro Kobayashi, Kikuchi-gun (JP); Keiichi Murayama, Kikuchi-gun (JP)

(73) Assignees: Mitsubishi Denki Kabushiki Kaisha, Tokyo (JP); Advanced Display Inc., Kikuchi-gun (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/969,950

(22) Filed: Oct. 22, 2004

(65) Prior Publication Data

US 2005/0052387 A1 Mar. 10, 2005

Related U.S. Application Data

(63) Continuation of application No. 09/912,310, filed on Jul. 26, 2001, now Pat. No. 6,825,821.

(30) Foreign Application Priority Data

Oct. 27, 2000 (JP) ..... 2000-329011
Jan. 29, 2001 (JP) ..... 2001-19786

(51) Int. Cl.
*G09G 3/36* (2006.01)

(52) U.S. Cl. ..... 345/87; 345/605; 345/606

(58) Field of Classification Search ..... 345/87, 345/88, 89, 90, 91, 92, 93, 94, 95, 96, 97, 345/98, 99, 100, 605, 606
See application file for complete search history.

(56) References Cited

U.S. PATENT DOCUMENTS 5,247,353 A * 9/1993 Cho et al. ..... 348/431.1
5,642,239 A * 6/1997 Nagai ..... 360/8

(Continued)

FOREIGN PATENT DOCUMENTS

JP 4-288589 10/1992

(Continued)

*Primary Examiner*—Xiao Wu
*Assistant Examiner*—Jean Lesperance
(74) *Attorney, Agent, or Firm*—Oblon, Spivak, McClelland, Maier & Neustadt, P.C.

(57) ABSTRACT

The present invention is directed to provide a driving circuit and driving method for a LCD having high performance of moving image displaying within few amount of memory and downscaled circuit. In the present invention, a voltage applied to a pixel to drive liquid crystal material in the pixel is determined as a voltage with which the transparency of the pixel at the end of the current field becomes the designated transparency. To determine the voltage, a data table for quick response in which output data is stored in correspondence with some of the possible value of a preceding field image data and some of the possible value of the current field image data is employed, and the output data corresponding to the preceding field image data and the current field image data is determined by the data table through linear interpolation. The voltage corresponding to the output data is applied to the pixel.

4 Claims, 14 Drawing Sheets

U.S. PATENT DOCUMENTS

| | | | |
|---|---|---|---|
| 5,841,411 | A | 11/1998 | Francis |
| 6,219,017 | B1 | 4/2001 | Shimada et al. |
| 6,271,817 | B1 | 8/2001 | Wakai et al. |
| 6,288,745 | B1 | 9/2001 | Okuno et al. |
| 6,501,451 | B1 | 12/2002 | Sakashita |

FOREIGN PATENT DOCUMENTS

| | | |
|---|---|---|
| JP | 2553713 | 8/1996 |
| JP | 2616652 | 3/1997 |
| JP | 2000-221475 | 8/2000 |

* cited by examiner

FIG. 3

20 data table for quick response

| | | current field image data | | | | |
|---|---|---|---|---|---|---|
| | gradation / gradation | 0 | 1 | 2 | ——·——·——·—— | 255 |
| preceding field image data | 0 | | | | | |
| | 1 | | | | | |
| | 2 | | | | | |
| | ——·——·—— | | | | output data | |
| | 255 | | | | | |

FIG. 7

20 data table for quick response

| | | | | current field image data | | | | |
|---|---|---|---|---|---|---|---|---|
| | | | jd | 0 | 1 | 2 | ——·——·—— | 7 |
| | | | | Td_div[jd] | | | | |
| | id | | | 0 | 32 | 48 | ——·——·—— | 255 |
| preceding field image data | 0 | Td_div[id] | 0 | | | | | |
| | 1 | | 32 | | | | | |
| | 2 | | 48 | | | | | |
| | ——·—— | | ——·—— | | | | output data Td[id][jd] | |
| | 7 | | 255 | | | | | |

FIG. 8(a)

image data of 256 gradations

0 —·— 15 16 —·— 31 32 —·— 47 48 —·— —·— 239 240 —·— 255

FIG. 8(b)

convert the data into upper 4 bits (16 gradations)

0 1 2 —·— —·— 15 store into frame memory

FIG. 8(c)

restore the image data into 256 gradations d_div[0] =0 d_div[1] =16 d_div[2] =32 —·—·—·— d_div[15] =240 d_div[16] =255

FIG. 11

20 data table for quick response

| | | current field image data | | | | |
|---|---|---|---|---|---|---|
| | jd | 0 | 1 | 2 | ——·——·—— | 7 |
| | | Td_div[jd] | | | | |
| | id | 0 | 32 | 48 | ——·——·—— | 255 |
| preceding field image data | 0 | | | | | |
| | 1 | | | | | |
| | 2 | | | | | |
| | ——·—— | | | | output data Td[id][jd] | |
| | 7 | | | | | |

FIG. 14

21 differential data table

| | | current field image data | | | | |
|---|---|---|---|---|---|---|
| | jd | 0 | 1 | 2 | ——-——-—— | 7 |
| | | Td_div[jd] | | | | |
| | id | 0 | 32 | 48 | ——-——-—— | 255 |
| preceding field image data | 0 | | | | | |
| | 1 | | | | | |
| | 2 | | | | | |
| | ——-——-—— | | | | differential data Td_v[id][jd] | |
| | 7 | | | | | |

DRIVING CIRCUIT AND DRIVING METHOD FOR LCD

CROSS REFERENCE TO RELATED APPLICATIONS

The present application is a continuation of, and claims the benefit of the earlier filing date of U.S. application Ser. No. 09/912,310, filed Jul. 26, 2001, now U.S. Pat. No. 6,825,821 which in turn claims priority to Japanese Application Nos. 2000-329011 and 2001-19786, filed Oct. 27, 2000, and Jan. 29, 2001, respectively. The contents of each of the above-identified applications is incorparated herein by reference.

BACKGROUND OF THE INVENTION

The present invention relates to a LCD (Liquid Crystal Display), more particularly, to a driving circuit and driving method for a LCD.

LCDs have many pixels arranged in rows and columns in their screen. Each pixel has its own electrode, i.e. pixel electrode, for applying a voltage to a liquid crystal material in that pixel. By selecting a row of pixels, the voltages are applied to the pixel electrodes in the selected row through column signal lines. Selecting all the rows sequentially, all the pixel electrodes in the screen are supplied with their own voltages. Through these voltages, the liquid crystal material in each pixel is driven and changes its orientation, thereby the amount of light passing through each pixel is controlled so that an image is displayed on the screen.

Meanwhile, it should be noted that LCDs typically have a common electrode which is commonly owned by all pixels, and to be precise, the voltage difference between the pixel electrode and the common electrode is applied to the liquid crystal material in the pixel to control the amount of passing light.

The time required for selecting all rows, i.e. all pixels in the screen, is referred to as "One field period", and a voltage applied to the liquid crystal material in each pixel is refreshed once in the "one field period. Of course in a case there is no need to change the displayed image in a pixel, the same voltage is again applied to that pixel.

Though a LCDs, which are lightweight, lower power consumption and display exquisite images, are used widely replacing the conventional CRT displays, there is a shortcoming of lower displaying quality for moving images.

As mentioned above, LCDs can display images by controlling the amount of passing lights through the orientations of liquid crystal material. Thus, when an image with motion is displayed, i.e. displayed image must be changed, the orientation of liquid crystal material must be changed by changing voltages applied to them. However, it requires relatively long time for a liquid crystal material in certain orientation to be changed into another orientation according to the newly applied voltage. Therefore, in case of displaying object which moves at high-speed, there is a problem which causes afterimage and blurred image since the liquid crystal material can not reach the desired orientation during the "one field period".

SUMMARY OF THE INVENTION

Therefore, an object of the present invention is to provide a driving circuit and a driving method for LCD having high displaying quality for moving images by accelerating response of liquid crystal material.

Another object of the present invention is to provide a driving circuit and a driving method for LCDs which can obtain high displaying quality for moving images with accelerating response of liquid crystal material within a limited memory and circuit scale.

In order to achieve the above mentioned objects, a driving method for driving LCD according to the present invention is characterizing in that a voltage applied to a pixel to drive liquid crystal material in the pixel is determined with a supplied current field image data which is designating the desired transparency of the pixel in the current field and the voltage applied to the pixel in the current field is determined as a voltage with which the transparency of the pixel at the end of the current field becomes the designated transparency.

A driving method for driving LCD according to the present invention is characterizing in that a voltage applied to a pixel in the current field is determined with the current field image data and a preceding field image data which are designating the desired transparency of the pixel in the current and preceding field, and the voltage applied to the pixel in the current field is determined as a voltage with which the transparency of the pixel at the end of the current field becomes the designated transparency.

And, a driving circuit for LCD according to the present invention comprises a frame memory in which a current field image data is stored and retrieved as a preceding field image data after delay of one field period, a data table for quick response in which output data is stored in correspondence with possible value of a preceding field image data and possible value of a current field image data, and a processor for determining an output data from the current field image data and the preceding field image data using the data table for quick response.

The driving circuit according to the present invention comprises a frame memory in which the current field image data is stored and retrieved as a preceding field image data after delay of one field period, a data table for quick response in which output data is stored in correspondence with some of the possible value of the preceding field image data and some of the possible value of the current field image data, and a processor for determining an output data from the current field image data and the preceding field image data using the data table for quick response.

A driving circuit for LCD according to the present invention further comprises a converting means which convert the bit length of the current field image data, a frame memory in which the current field image data is stored and retrieved as the preceding field image data after delay of one field period, the data table for quick response in which output data is stored in correspondence with some of the possible value of the preceding field image data and some of the possible value of the current field image data, and the processor for determining an output data from the current field image data and the preceding field image data using the data table for quick response. The number of the possible preceding field image data on the data table preferably equals to the number represented with bit length of the preceding field image data.

The driving circuit for LCD according to the present invention comprising the frame memory in which a current field image data is stored and retrieved as a preceding field image data after delay of one field period, the data table for quick response in which output data is stored in correspondence with some of the possible value of a preceding field image data and some of the possible value of a current field image data, a differential data table in which differential data is stored in correspondence with the some of the possible value of a preceding field image data and the some of the possible value of a current field image data, and a processor for determining an output data from the current field image data and the preceding field image data using the data table for quick response and the differential data table.

The driving circuit for LCD according to the present invention comprising the converting means which convert the bit length of the current field image data, the frame memory in which a current field image data is stored and retrieved as a preceding field image data after delay of one field period, the data table for quick response in which output data is stored in correspondence with some of the possible value of a preceding field image data and some of the possible value of a current field image data, the differential data table in which differential data is stored in correspondence with the some of the possible value of a preceding field image data and the some of the possible value of a current field image data, and a processor for determining an output data from the current field image data and the preceding field image data using the data table for quick response and the differential data table. The number of the possible preceding field image data on the data tables preferably equal to the number represented with bit length of the preceding field image data.

In the driving circuits for LCD according to the present invention, a voltage applied to a pixel during the current field to drive liquid crystal material in the pixel is preferably determined by the output data so that the transparency of the pixel at the end of the current field becomes the transparency designated by the current field image data.

The driving method for driving LCD according to the present invention, in which an output data is determined from preceding field image data and current field image data using a data table for quick response storing output data in correspondence with the preceding field image data and the current field image data, and a voltage corresponding to the output data is applied to a pixel to drive liquid crystal material in the pixel, comprises the steps of retrieving four output data defined with two preceding field image data and two current field image data which are closest to the preceding field image data and the current field image data respectively from the data table, and determining the output data corresponding to the preceding field image data and the current field image data by linear interpolation using the four output data.

In the method for driving LCD above described, the output data corresponding to the preceding field image data and the current field image data may be determined by linear interpolation using three of the four output data.

The driving method for driving LCD according to the present invention, in which an output data is determined from preceding field image data and current field image data using a data table for quick response storing output data in correspondence with the preceding field image data and the current field image data, and a voltage corresponding to the output data is applied to a pixel to drive liquid crystal material in the pixel is characterized in that the number of the possible preceding field image data on the data table equals to the number represented with bit length of the preceding field image data, two output data defined with the preceding field image data and two current field image data which are closest to the current field image are retrieved from the data table, and the output data corresponding to the preceding field image data and the current field image data is determined by linear interpolation using the two output data.

The driving method for driving LCD, wherein a preceding field image data which is obtained through converting bit length of an image data of preceding field, a current field image data, and a converted current field image data which is obtained through converting bit length of the current field image data are employed to determine an output data, and voltage corresponding to the output data is applied to a pixel to drive liquid crystal material in the pixel, comprises the steps of retrieving an output data defined with the preceding field image data and the converted current field image data from a data table for quick response, retrieving a differential data defined with the preceding field image data and the converted current field image data from a differential data table, multiplying the retrieved differential data by a difference between the current field image data and the converted current field image data, and adding the multiplied differential data and the retrieved output data to obtain the output data.

In the driving methods for LCD according to the present invention, the voltage applied to the pixel is preferably determined by the output data so that the transparency of the pixel at the end of the current field becomes the transparency designated by the current field image data.

BRIEF DESCRIPTION OF THE DRAWINGS

FIG. 3 shows a data table for quick response according to the present invention;

FIG. 7 is a data table for quick response according to the present invention;

FIG. 8 is a diagram describing conversion and reconversion of bit length of an image data employing thresholds;

FIG. 11 is a data table for quick response according to the present invention;

FIG. 14 shows a difference data table for interpolation table according to the present invention.

DETAILED DESCRIPTION

EMBODIMENT 1

The description of the first embodiment of the present invention will be given with referring to FIG. 1.

Figure 1:
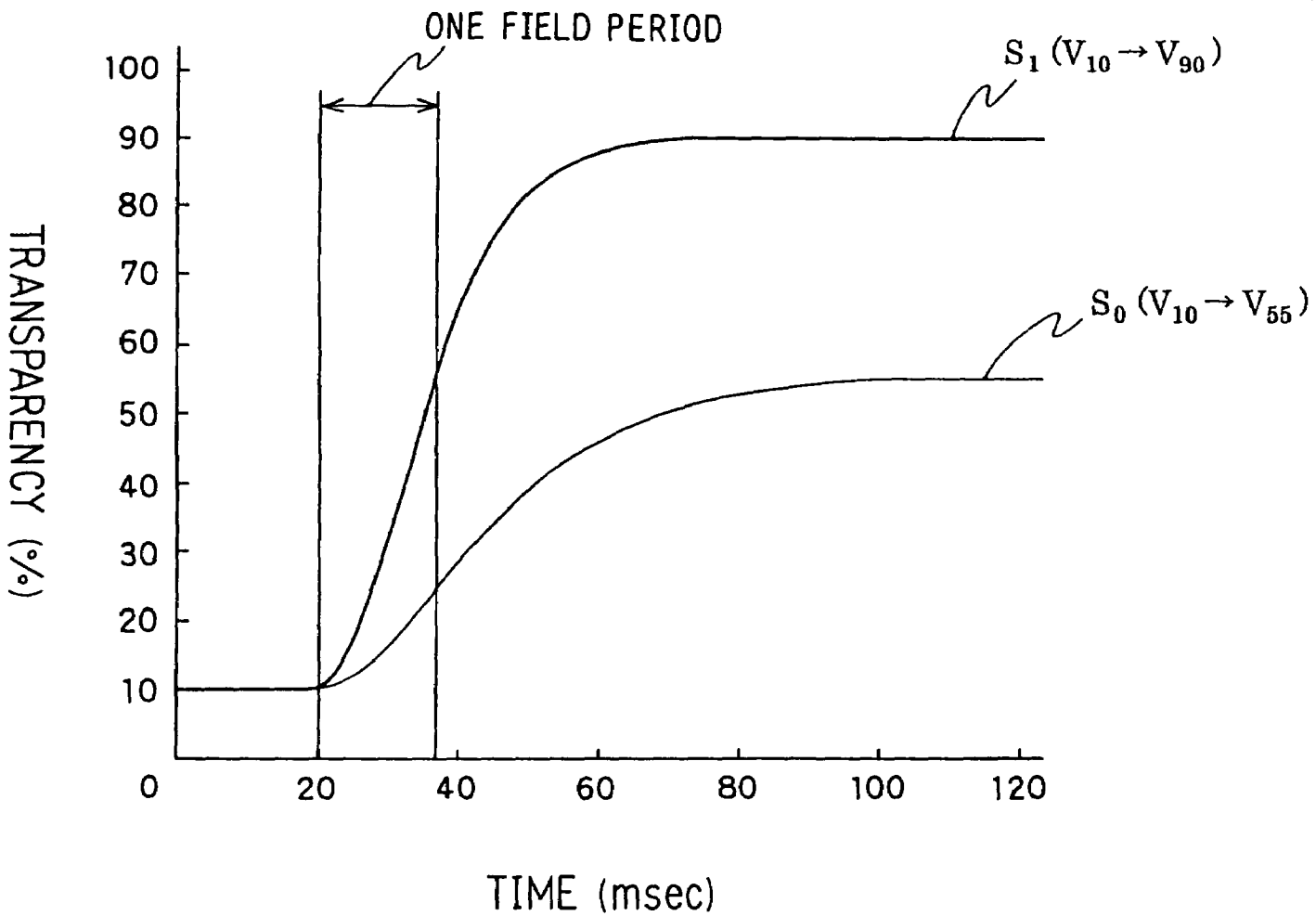
FIG. 1 is a graph showing a relation between an applied voltage and a transparency according to driving method of prior art and that of the present invention.

FIG. 1 shows a relation between an applied voltage and a transparency in a pixel with presenting time (msec) in horizontal axis and transparency (%) in vertical axis. A displayed image is refreshed by a frequency of 60 Hz in most LCDs, so one field period is approximately 16.6 msec in FIG. 1. In FIG. 1, the transparency in a pixel is 10% in preceding field (until 20 msec) and to be changed to 55% in the following current field.

In the prior art LCDs, as presented by thin line $S_0$ in FIG. 1, a voltage with which the transparency of 55% can be obtained after plenty of time to complete response of liquid crystal material (hereinafter referred as $V_{55}$) is applied. Thus, the transparency in a pixel shall not reach 55% during the current field, thereby deteriorating the displaying quality for moving image.

In the present invention, however, a voltage with which transparency of 55% can be obtained at the end of the current field, i.e. within one field period, is applied. As presented with heavy line $S_1$ in FIG. 1, by applying a voltage $V_{90}$ with which transparency of 90% can be obtained after plenty of time, the transparency of 55% can be obtained at the end of the current field.

In the present embodiment as described above, a voltage with which the desired transparency can be achieved at the end of the field is applied in that field to the liquid crystal material in each pixel. Therefore it is possible to obtain LCDs which can achieve high displaying quality for moving image without perceiving after image and blurring.

EMBODIMENT 2

Figure 2:
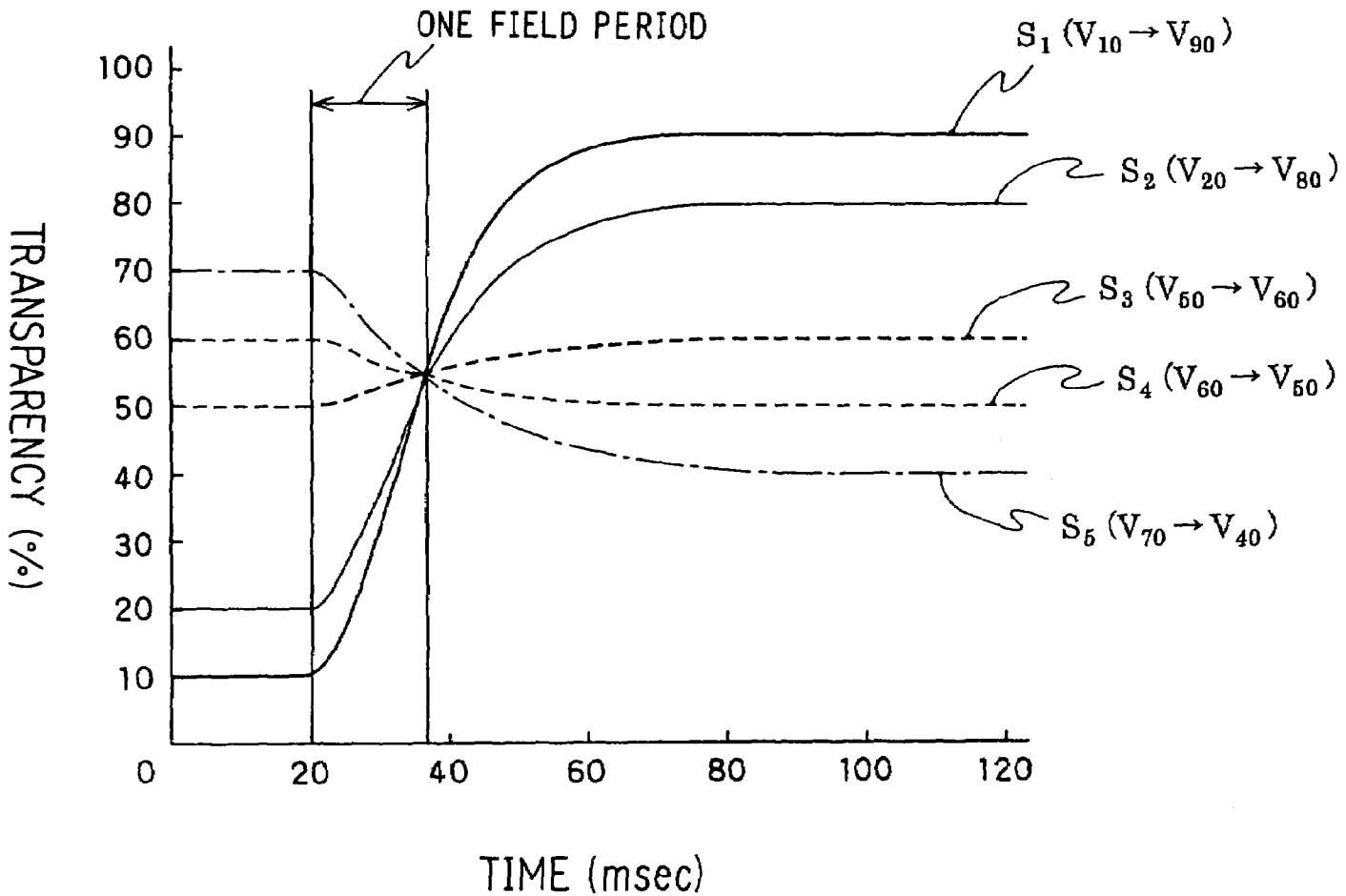
FIG. 2 is a graph showing the relation between applied voltage and the transparency at the end of "one field period" against various transparencies at preceding field.

FIG. 2 shows a relation between applied voltage and the transparency in a pixel with presenting time in horizontal axis and transparency in vertical axis. In FIG. 2, required voltages at the current field to obtain a desired transparency of 55% are shown in correspondence with various transparencies in preceding field. When the transparency of the preceding field is 20%, applying a voltage of $V_{80}$, i.e. a voltage whereby transparency of the pixel at the completion of response of liquid crystal material becomes 80%, enables to obtain the transparency of 55% at the end of the current field. Similarly, with each of the transparency of 50%, 60% and 70% of the preceding field, applying a voltage of $V_{60}$, $V_{50}$ and $V_{40}$ enable to achieve the desired transparency of 55% at the end of the current field.

Thus, a voltage for obtaining desired transparency at the end of the field can be determined by the transparency at the preceding field uniquely. Therefore, it is possible to obtain the desired transparency of the pixels at the end of the field employing a two dimensional table in which transparency of the preceding field and the desired transparency of the current field are presented in rows and columns respectively and voltage to be applied during the current field are presented at the intersection of them, so that LCDs with high performance of moving image displaying can be achieved.

Figure 4:
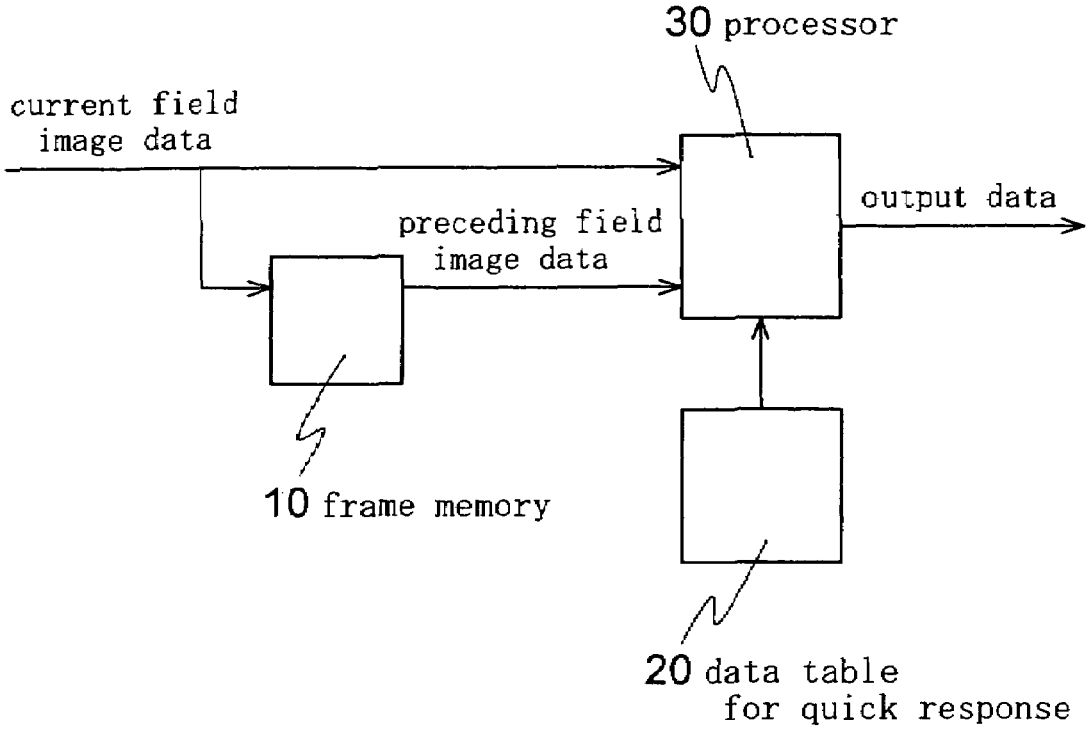
FIG. 4 is a schematic diagram of a driving circuit according to the present invention.
Figure 5:
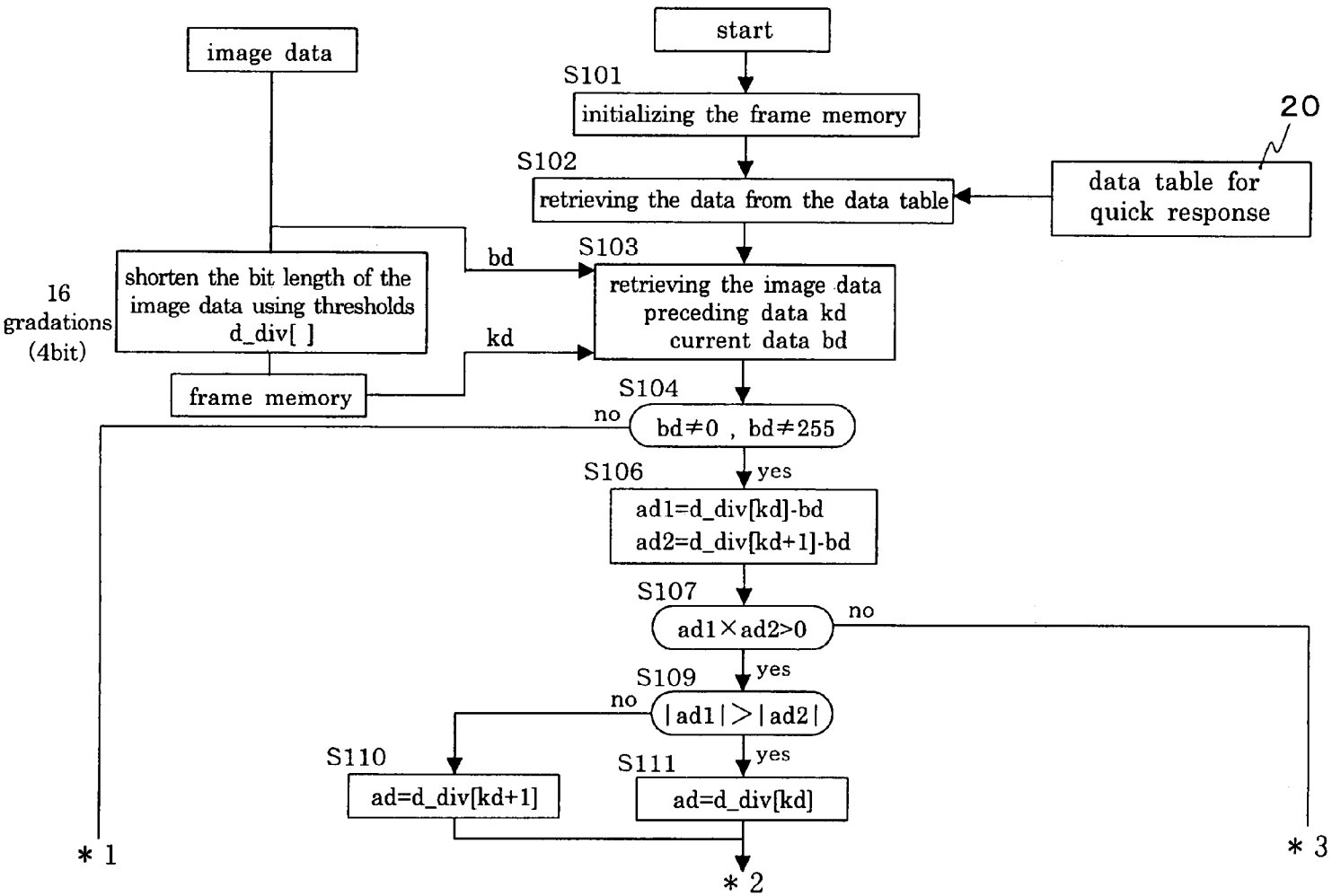
FIG. 5 is a flow chart describing the operation of a driving circuit according to the third embodiment of the present invention.
Figure 6:
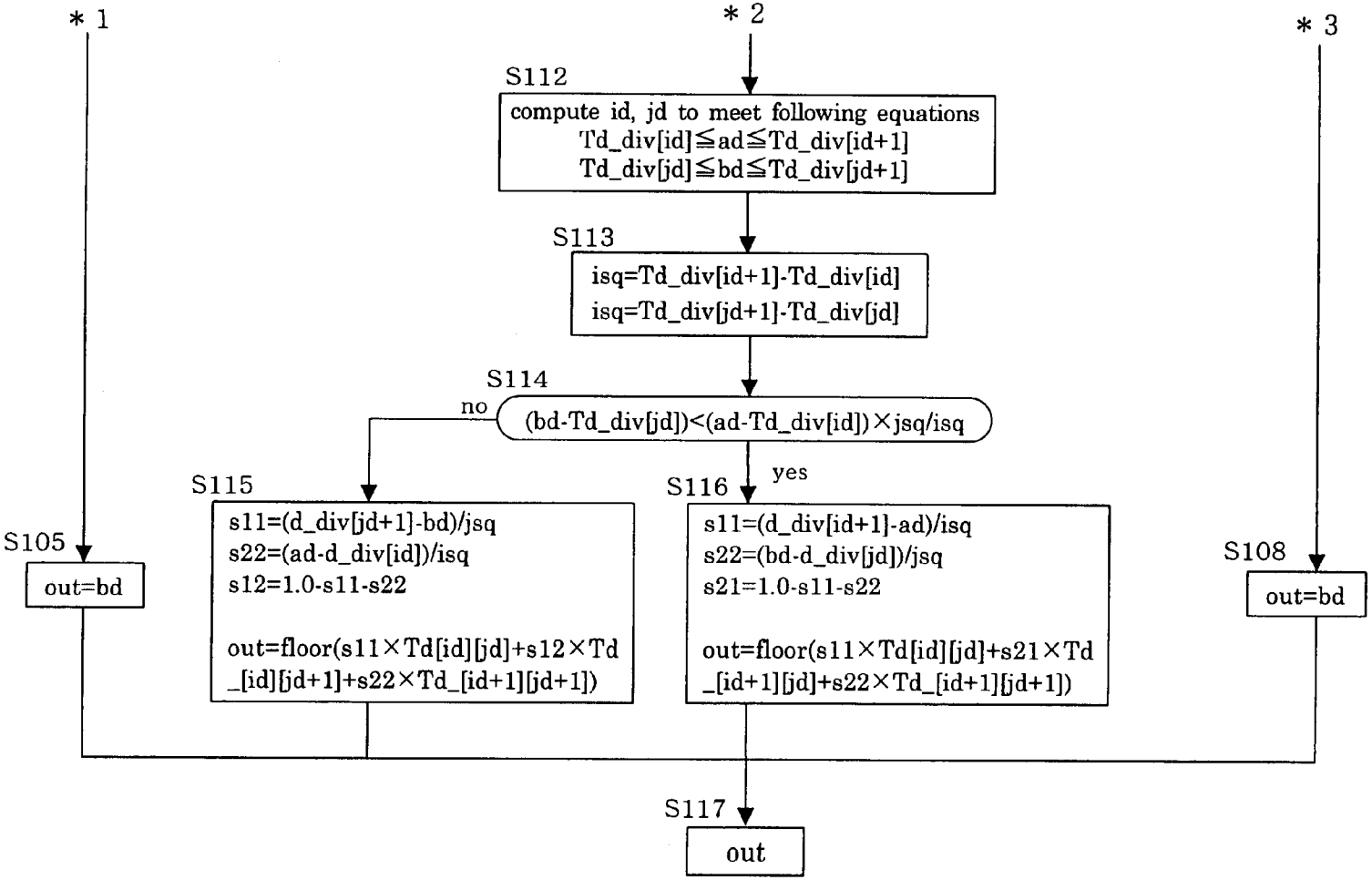
FIG. 6 is a flow chart describing the operation of a driving circuit according to the third embodiment of the present invention.

An example of the table is in FIG. 3, an example of the driving circuit employing the table is shown in FIG. 4. The table is referred to as "data table 20 for quick response", wherein image data of the preceding field and image data of the current field are shown in rows and columns respectively as transparency of 256 gradations.

As shown in FIG. 4, the data table 20 for quick response is connected with a processor 30. The current field image data from signal source is supplied to the processor 30 and frame memory 10. The frame memory 10 stores the current field image data, and stored data is retrieved as a preceding field image data after "one field period" has passed. The processor 30 applies the gradation of the current field image data to rows and the gradation of retrieved preceding field image data to columns in the data table 20 for quick response, and outputs the data on the intersection.

As described above, each output data in the data table 20 for quick response is determined as a gradation data corresponding to a necessary voltage for changing the transparency of the preceding field image data into that of the current field image data within "one field period". For instance, in a case where a gradation of already shown image, i.e. the preceding field image data, is "64" and a gradation of an image to be displayed, i.e. the current field image data, is "128", the value larger than the gradation "128" such as the gradation "144" is assumed to be an output data so as to emphasize the difference between them. The response of liquid crystal material is accelerated by applying the voltage corresponding to the gradation of "144", thereby achieves the display of desired gradation "128" at the end of the current field.

In the prior art LCDs wherein the data table 20 for quick response and the processor 30 are not employed, in a case where the gradation of the current field image data is "128", a voltage corresponding to the gradation of "128" is applied to liquid crystal material, therefore it requires more time than "one field period" to make the orientation of the liquid crystal material steady state corresponding to the gradation of "128". On the other hand, in the method of the present invention, since a voltage corresponding to a gradation of "144" is applied to the liquid crystal material, a response of the liquid crystal material is improved and therefore the gradation of "128" can be achieved within the "one field period". As described above, setting each output data of the data table 20 for quick response with corresponding to the current and preceding field image data enables to improve the displaying quality for moving image.

Of course, the method requires a data table for quick response and a frame memory. As described example, in a case where the preceding field image data, current field image data and the output data have 256 gradations respectively, the size of data table for quick response is assumed to be 64 Kbyte. Further, in a case where a LCDs is XGA type consists of 1024×768 pixels, and each pixel comprises three sub-pixels of RGB each having 256 gradations, the size of frame memory for storing the preceding field image data is assumed to be approximately 2.3 Mbyte.

Thus, this method may expand circuit scale and cost high because of the necessity of great amount of memory and a number of data lines for connecting a frame memory and a data table for quick response to the processor.

EMBODIMENT 3

The third embodiment of the present invention will be described with referring to FIGS. 5, 6, 7, 8 and 9. In the present embodiment, a data table for quick response has output data of 256 gradations in correspondence with the preceding and current field image data of 8 gradations selected from 256 gradations. Therefore the required size of data table for quick response is only 64 byte thereby enables to reduce the amount of memory and the number of data line connected to a processor.

Hereinafter, the operation of a driving circuit according to the present embodiment will be described with attached flow chart. Due to limitations of space, the flow chart is divided into two sheets, i.e. FIG. 5 and FIG. 6, at the points marked with "*1", "*2"and "*3".

Firstly, a frame memory is initialized at step S101, and the image data from a signal source is stored temporally. At this time it is possible to reduce the size of frame memory by storing converted image data in which bit length of the image data is shortened employing thresholds. Bit length is converted with picking up the upper four bits of the 256 gradations image data as shown in FIGS. 8(*a*) and 8(*b*). The image data stored into the frame memory is read out as the preceding field image data "kd" after delay of "one field period" in a following step S103.

Next, data on the data table 20 for quick response are retrieved in step S102. As shown in FIG. 7, the data table 20 for quick response comprises eight gradations of the preceding field image data Td_div[id] corresponding to id=0 to 7, eight gradations of the current field image data Td_div[jd] corresponding to jd=0 to 7 and 256 gradations of the output data Td[id][jd] corresponding to the eight gradations of Td_div[id] and Td_div[jd].

Further the current field image data "bd" and the preceding field image data "kd" are provided in the step S103. The current field image data "bd" is provided from the signal source and the preceding field image data "kd" is retrieved from the frame memory. In the present embodiment, the current field image data "bd" is a data of 256 gradations, and the preceding field image data "kd" is a data of 4 bit, i.e. 16 gradations.

In the following step S104, the gradation of current field image data "bd" is judged to be "0" or "255". In case of the "bd" equals to "0", the gradation "0" gives the voltage which is nearest to a voltage to be the gradation "0" within "one field period". In case of the "bd" equals to "255", the gradation "255" gives the voltage which is nearest to a voltage to be the gradation "255" within "one field period". Thus, in this case, the current field image data "bd" is output as an output data "out" in step S105. Concerning with this case, it should be noted that the voltage applied to the pixel is decided based on the gradation data, therefore the excess or lesser voltage which is not in correspondence with the gradation data of "0" to "255" could not be applied.

When the gradation of the current field image data "bd" is neither "0" nor "255", the output data "out" is decided by the data table for quick response. In the present embodiment, a data table for quick response only includes the output data corresponding to eight gradations of current and preceding field image data, therefore an output data "out" corresponding to 256 gradations of the current and preceding field image data is calculated by performing two dimensional linear interpolation. The method of the interpolation is as follows.

Firstly, the preceding field image data "kd", which is converted into 16 gradations by bit length conversion, is reconverted into 256 gradations. This reconversion employs thresholds used at conversion to 16 gradations. However, as shown FIGS. 8(*b*) and 8(*c*), there are two threshold to give the image data "kd" of 16 gradations, that is, the lower threshold d_div[kd] and the upper threshold d_div[kd+1]. Therefore, it must be decided whether to convert the preceding field image data "kd" of 16 gradations into threshold d_div[kd] or threshold d_div[kd+1].

So, the decision is performed employing the current field image data "bd". Firstly, in step S106, the difference "ad1" and "ad2" is calculated by subtracting the current field image data "bd" from two thresholds d_div[kd] and d_div [kd+1] of the preceding field image data "kd" respectively. In a case where the absolute value of "ad1" is larger than that of "ad2", the threshold d div[kd] is assumed to be the reconverted preceding field image data "ad" in step S109 and S110. On the other hand, when the absolute value of "ad2" is larger, the threshold d_div[kd+1] is assumed to be the reconverted preceding field image data "ad" in steps S109 and S111.

In the following step S112, the position of reconverted preceding field image data "ad" and the current field image data "bd" on the data table for quick response is calculated. As already described in FIG. 7, the data table for quick response includes eight gradations Td_div[id] of the preceding field image data corresponding to id=0 to 7 in rows and eight gradations Td_div[jd] of the current field image data corresponding to jd=0 to 7 in columns. Therefore, comparing the image data "ad" and "bd" with gradations Td_div[id] and Td_div[jd] respectively, the position of the image data "ad" and "bd" among 49 (7× 7) grids having the 8 gradations of Td_div[id] and Td_div[jd] as boundaries is calculated.

Figure 9:
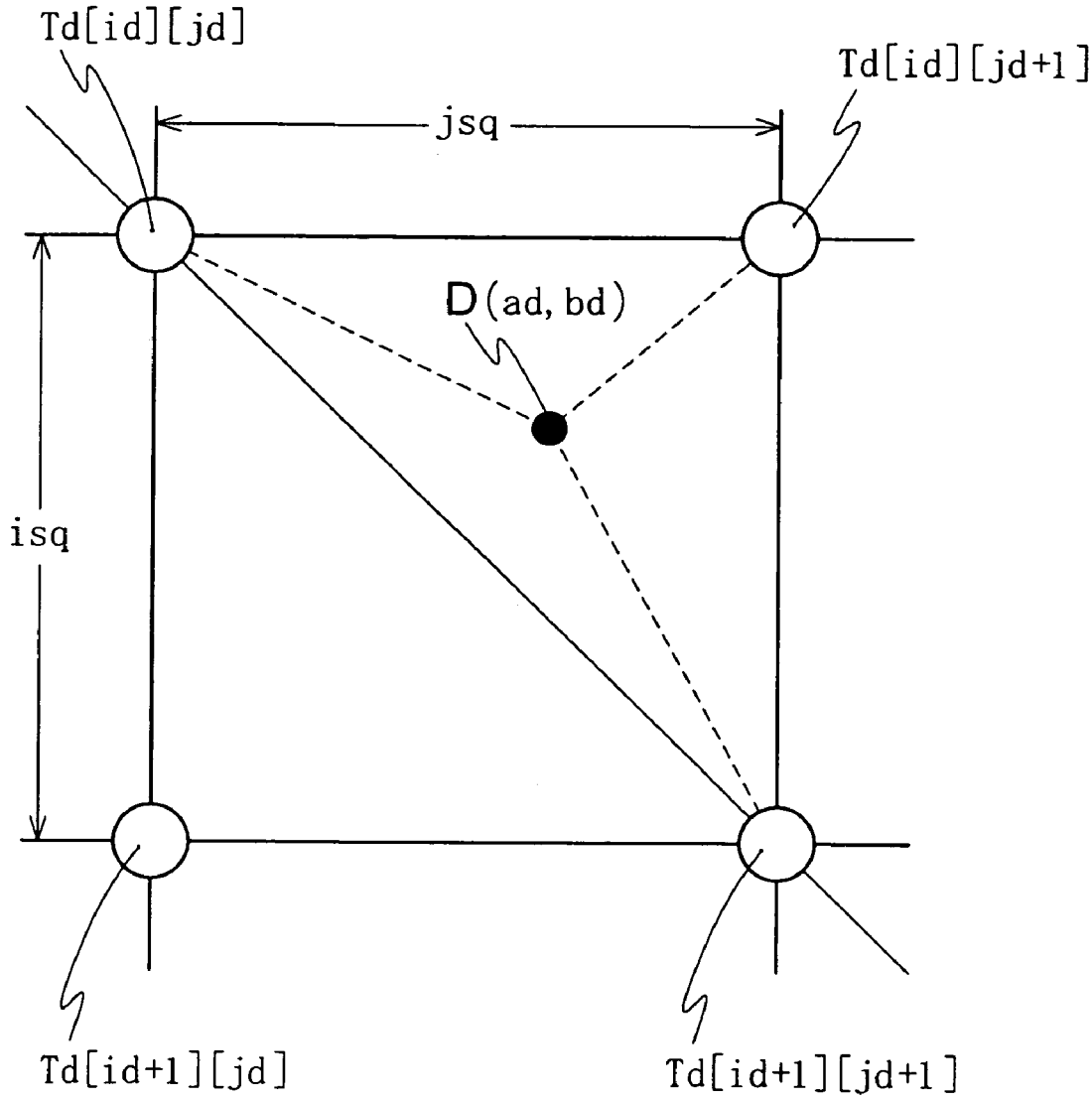
FIG. 9 is a diagram describing linear interpolation employing the data table for quick response.

As the result of calculation, in a case where the preceding frame image data "ad" is positioned between gradation Td_div[id] and Td_div[id+1] and the current flame image data "bd" is positioned between gradation Td_div[jd] and Td_div[jd+1], the position of the data D (ad, bd) on the data table for quick response is as shown in FIG. 9. Here, Td[id][jd] is meant as an output data in a case where a gradation of the preceding frame image data is Td_div[jd] and a gradation of the current flame image data is Td_div [jd].

An output data "out" for data D (ad, bd) is calculated using output data Td[id][jd], Td[id][jb+1], Td[id+1][jd] and Td[id+1][jd+1] in the four corner of grid in which data D (ad, bd) belongs.

Firstly, in step S113, the difference "isq" between the gradation of preceding field image data Td_div[id+1] and Td_div[id], and the difference "jsq" between the gradation of current field image data Td_div[jd+1] and Td_div[jd] are calculated respectively.

In the following step S114, it is judged whether data D (ad, bd) is positioned at an upper right or a lower left of a triangular area which is partitioned by thin line through the grid shown in FIG. 9. When data D (ad, bd) is positioned in the upper right triangular area, an output data "out" is calculated in a following step S115.

In the step S115, the output data "out" is calculated with using the output data Td[id][jd], Td[id][jd+1] and Td[id+1] [jd+1] on the data table, such that the ratio of three differences, i.e. differences between the output data "out" and the three output data Td[id][jd], Td[id][jd+1] and Td[id+1][jd+1], to be equal to the ratio of three distances, i.e. distances between the data D (ad, bd) and three corner of the triangular area.

In case where the data D (ad, bd) is judged being in a lower left triangular area, the output data "out" is calculated in a same manner of step S115 in step S116.

The output data "out" is output in step S117 and a voltage corresponding to the output data "out" shall be applied to liquid crystal material in each pixel.

As described above, according to the present embodiment, the data table for quick response comprises output data corresponding to only eight gradations of the preceding and current field image data respectively, and the output data corresponding to the preceding and current field image data of 256 gradations are calculated by linear interpolation, thereby contributing to a downscaled driving circuit with reducing the amount of memory for storing data table for quick response and the number of data line for connecting the data table with a processor.

Further, the converted image data, in which the amount of data is stored into the frame memory reduced by shortening its bit length, thereby enables to downscale the driving circuit with reducing the size of frame memory and the number of data line for connecting the frame memory with the processor.

Though the preceding field image data, the current field image data and the output data have 256 gradations respectively, and the data table for quick response is composed of eight gradations of the preceding and current field image data in the present embodiment, the gradation other than the above is also applicable.

In the present embodiment, the image data is stored into the frame memory after converted into four bits. However, the bit length after the conversion can be determined in consideration of necessary amount of memory, error caused by conversion and reconversion, and load of calculation at conversion and reconversion in the processor.

In the present embodiment, the image data, which is converted and shortened in its bit length, is stored into the frame memory and retrieved as a preceding field image data. Thus the lower bits rounded at converting shall appear as an error at reconverting, and even in a case where there is no change between the preceding field image data and the current field image data, i.e. still image must be displayed, the still image may not be displayed accurately since the reconverted preceding field image data and the current field image data have different value.

Therefore step S107 are added to judge whether it is still image or not, and in case of the still image is required, the current field image data "bd" is to be output as the output "out" in step S108. In step S107, in a case where the current field image data "bd" is larger than the lower threshold d_div[kd] of the preceding field image data "kd" and smaller than the upper threshold d_div[kd+1] of the preceding field image data "kd", it is judged to be a still image.

EMBODIMENT 4

Figure 10:
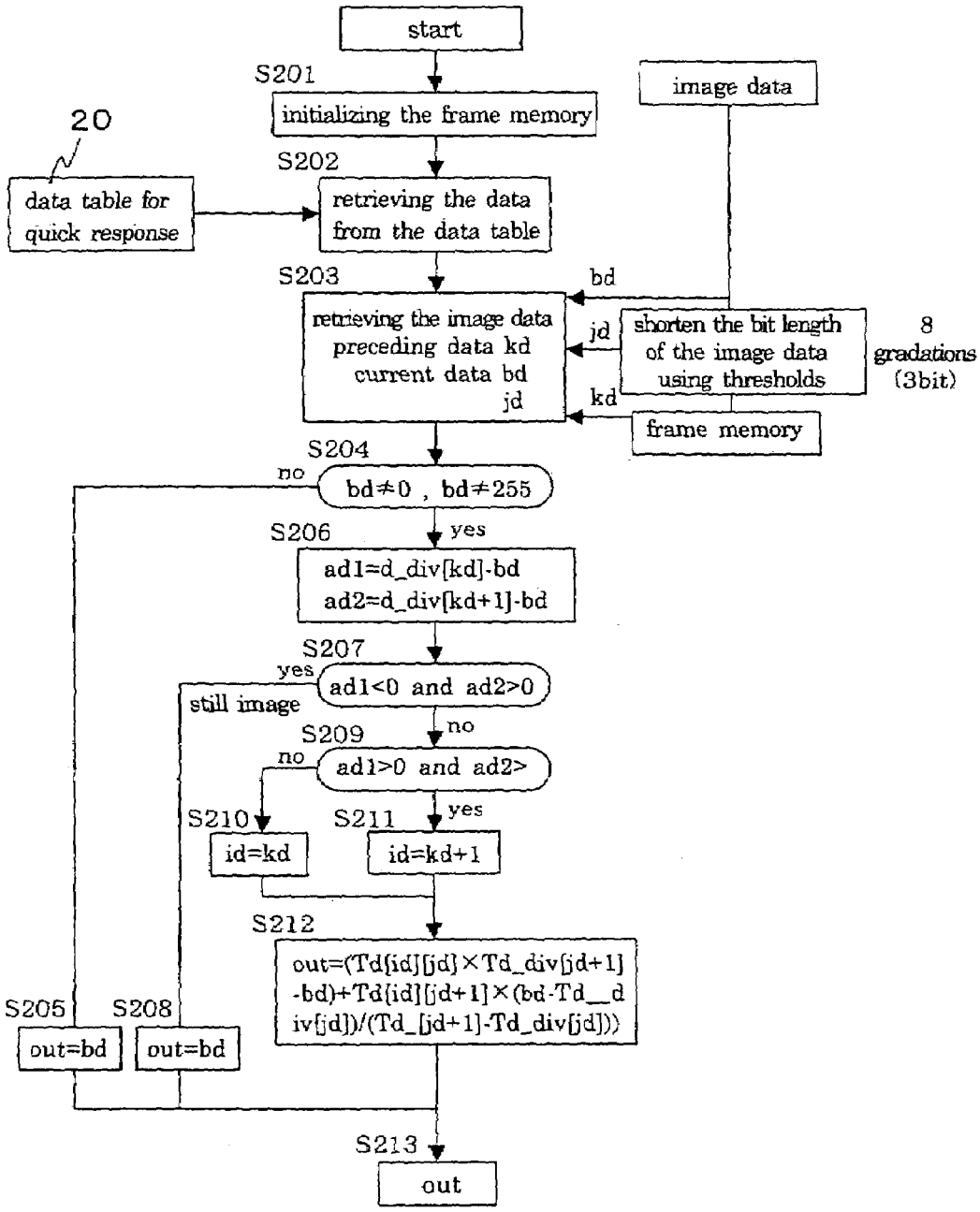
FIG. 10 is a flow chart describing the operation of a driving circuit according to the fourth embodiment of the present invention.

The fourth embodiment of the present invention will be described with referring to FIGS. 10, 11 and 12. FIG. 10 is a flow chart showing the operation of a driving circuit according to the present embodiment.

Firstly, a frame memory is initialized at step S201, and the image data from a signal source is stored temporally. At this time, the image data is converted using thresholds to shorten its bit length and the converted image data is stored into the frame memory. The detailed description of conversion of bit length is omitted here, refer to the third embodiment of the present invention (FIG. 8). The image data stored in the frame memory is read out as the preceding field image data "kd" after delay of "one field period" in a step S203.

In step S202, data on the data table 20 for quick response are lo retrieved. As shown in FIG. 11, the data table 20 for quick response comprises eight gradations of the preceding field image data thus converted corresponding to id=0 to 7, eight gradations of the current filed image data Td_div[jd] corresponding to jd=0 to 7 and 256 gradations of output data Td[id][jd] corresponding to the eight gradations of the preceding field image data and Td_div[jd].

Further, the current field image data and the preceding field image data "kd" are provided in step S203. Concerning with the current field image data, both eight gradations of the current field image data "jd" which is converted employing the threshold of eight gradations Td_div[jd] and the current field image data "bd" which is not converted, i.e. the image data of 256 gradations in this embodiment, are retrieved.

In the following step S204, the gradation of the current field image data "bd" is judged to be "0" or "255". In case of the "bd" equals to "0", the gradation "0" gives the voltage which is the nearest to a voltage to be the gradation "0" within "one field period". In case of the "bd" equals to "255", the gradation "255" gives the voltage which is the nearest to a voltage to be the gradation "255" within "one field period". Thus, in this case, the current field image data "bd" is output as an output data "out" in step S205.

When the gradation of the current field image data "bd" is neither 0 nor 255, the output data "out" is decided by the data table for quick response. In the present embodiment, a data table for quick response only includes the output data corresponding to eight gradations of current and preceding field image data respectively, therefore an output data "out" corresponding to 256 gradations of the current field image data "bd" is calculated by performing linear interpolation. The method of the interpolation is as follows.

In steps S206 and S207, the preceding field image data "kd" and the current field image data "bd" are compared. Since the preceding field image data "kd" was converted into eight gradations, it must be reconverted into 256 gradations employing the same thresholds used at conversion. Detailed description of reconversion is omitted here, refer to the third embodiment (FIG. 8). After reconversion of the preceding field image data "kd" of eight gradation into the lower threshold d_div[kd] and the upper threshold d_div [kd+1], these two thresholds are compared with the current field image data "bd".

When the current field image data "bd" is more than the lower threshold d_div[kd] and less than the upper threshold d_div[kd+1], it means that there is no or few change between the current and the preceding field image data (that is, still image is required). Thus, in this case, the current field image data "bd" is output as an output data "out" in step S208.

In a step S209, it must be decided whether the preceding field image data "kd" giving lower thresholds d_div[kd] or the preceding field image data "kd+1" giving upper threshold d_div[kd+1] should be used as the preceding field image data "id" at the application of a data table for quick response.

In a case where the current field image data "bd" is smaller than the lower threshold d_div[kd], the preceding field image data "kd" giving the lower thresholds d_div[kd] is assumed to be equal to the preceding field image data "id" at the application of the data table for quick response in step S210. On the other hand, in a case where the current field image data "bd" is larger than the upper thresholds d_div [kd+1], the preceding field image data "kd+1" giving the upper threshold d_div[kd+1] is assumed to be equal to the preceding field image data "id" at the application of the data table for quick response in step S211. Thus, by determining the preceding field image data "id" as described above, it is possible to prevent an overdone acceleration of liquid crystal material so that moderate image between the transparencies of the current and preceding field image data is obtained at the end of "one field period".

With using the preceding field image data "id" determined in steps S210 or S211 and the converted current field image data "jd" which is retrieved in step S203, the output data Td[id][jd] corresponding to them is read out from the data table for quick response. The current field image data "bd" before conversion is the midpoint between threshold Td_div [jd] for the converted current field image data "jd" and threshold Td_div[jd+1] for the converted current field image data "jd+1", therefore the output data Td[id][jd+1] corresponding to the preceding field image data "id" and converted current field image data "jd+1" is also read out from the data table for quick response.

Figure 12:
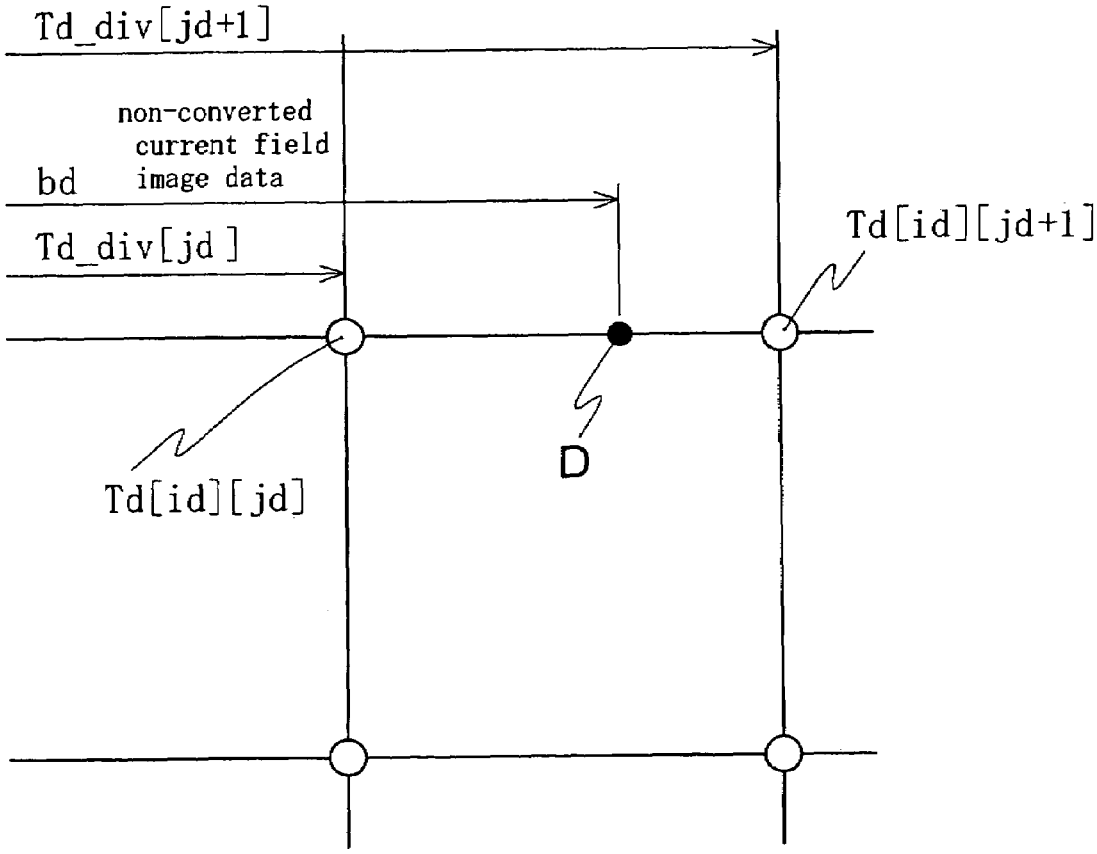
FIG. 12 is a diagram describing linear interpolation with employing the data table for quick response.

The relation between the output data Td[id][jd], Td[id][j+1], the preceding field image data "id" and non-converted current field image data "bd" is as shown in FIG. 12. Thus, the output data "out" corresponding to the current field image data "bd" is calculated by performing one dimensional linear interpolation such that the ratio of two distances, i.e. from "jd" and "jd+1" to "bd", to be equal to the ratio of two differences, i.e. from Td[id][jd] and Td[id][d+1], to the output data "out" in step S212.

The output data "out" is output in step S213, and a voltage corresponding to the output data "out" shall be applied to liquid crystal material in each pixel.

As described above, according to the present embodiment, the data table for quick response comprises output data corresponding to only eight gradations of the preceding and current field image data, and the output data corresponding to the preceding field image data converted into eight gradations and the current field image data of 256 gradations are calculated by linear interpolation, thereby downscaling driving circuit with reducing the amount of memory for storing the data table and decreasing the number of data line for connecting the data table with a processor.

Further, the converted image data, in which the amount of data is reduced by shortening its bit length, is stored into the frame memory, thereby enables to downscale the driving circuit with reducing the size of frame memory and the number of data line for connecting the frame memory with the processor.

Though the preceding field image data, the current field image data and the output data have 256 gradations respectively, and the data table for quick response is composed of eight gradations of the preceding and current field image data in the present embodiment, the gradation other than the above is also applicable.

Gradations of the converted preceding field image data, i.e. gradations of the preceding field image data on the data table and in the frame memory, can be determined in consideration of a necessary amount of memory, error and necessary amount of calculation at conversion and reconversion

EMBODIMENT 5

The fifth embodiment of the present invention will be described with referring to FIGS. 13 and 14. In the fourth embodiment, an output data is determined by performing linear interpolation based on adjacent two output data Td[id][jd] and Td[id][jd] on the data tale for quick response. On the other hand, in this fifth embodiment, a differential data of a differential data table is used in addition to the data table for quick response to perform interpolation onto an output data of the data table for quick response.

Figure 13:
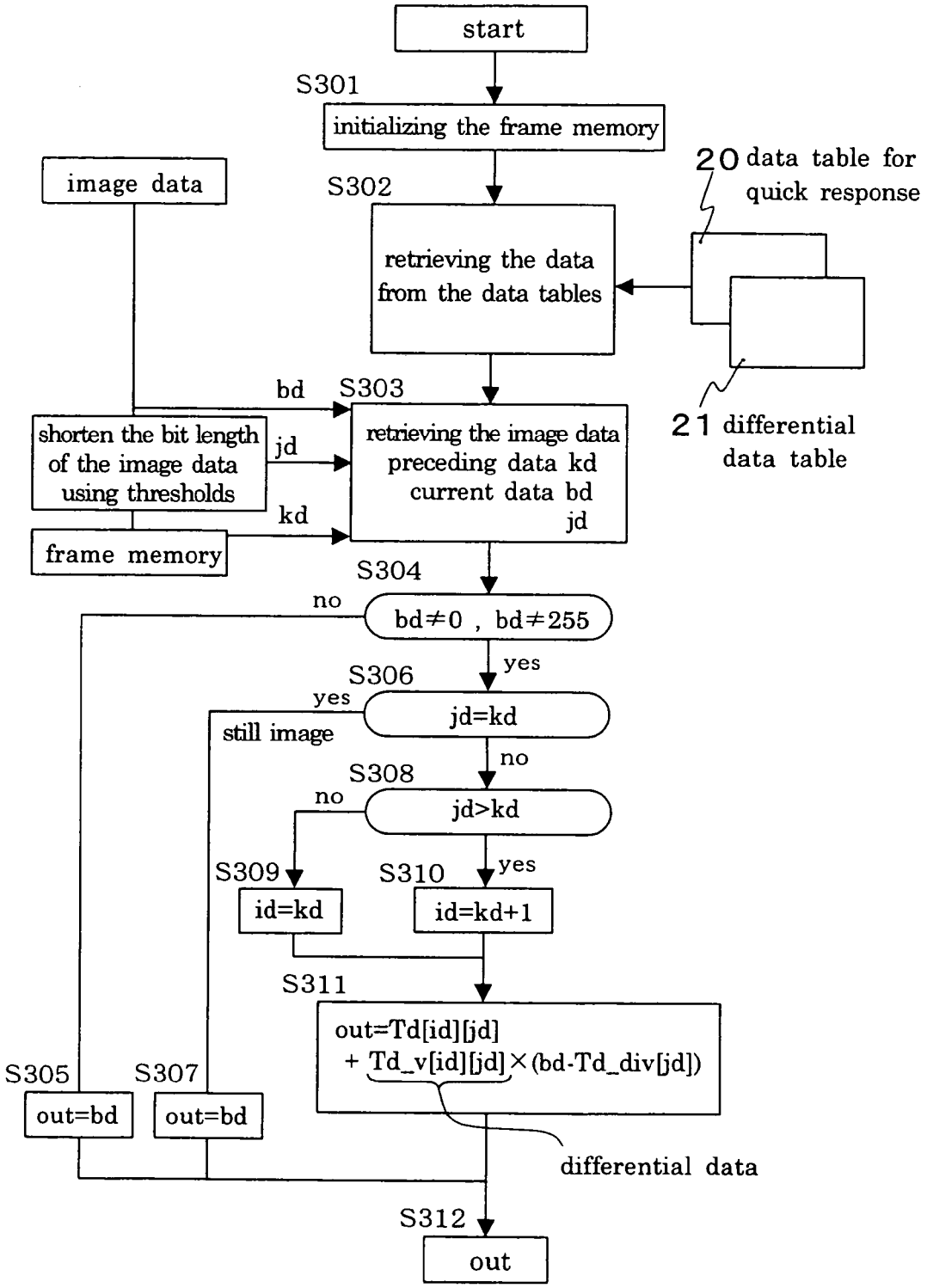
FIG. 13 is a flow chart describing the operation of a driving circuit according to the fifth embodiment of the present invention.

FIG. 13 is a flow chart showing the operation of a driving circuit according to the present embodiment.

Firstly, a frame memory is initialized in step S301, wherein the image data from a signal source is stored temporally after conversion of its bit length employing the thresholds. The description of conversion of bit length is omitted here, refer to the third embodiment of the present invention (FIG. 8). The image data stored in the frame memory is read out as the preceding field image data "kd" after delay of "one field period" in the following step S303.

Next, data on the data table 20 for quick response and differential data table 21 are retrieved in step S302. As shown in FIG. 11 of the fourth embodiment, the data table 20 for quick response comprises eight gradations of the preceding field image data thus converted corresponding to id=0 to 7, eight gradations of the current field image data corresponding to Td_div[jd] corresponding to jd=0 to 7 and 256 gradations of output data Td[id][jd] corresponding to the eight gradations of the preceding field image data and Td_div[jd]. The differential data table 21 also comprises eight gradations of the converted preceding field image data corresponding to id=0 to 7, eight gradations of the current field image data Td_div[jd] corresponding to jd=0 to 7 and the differential data Td_v[id][jd] for interpolation corresponding to the eight gradations of "id" and Td_div[jd].

Further, the current field image data and the preceding field image data "kd" are provided in step S303. Concerning with the current field image data, both eight gradations of the current field image data "jd" which is converted employing the threshold of eight gradations of Td_div[jd] and the current field image data "bd" which is not converted, i.e. the image data of 256 gradations in this embodiment, are retrieved.

In the following step S304, the gradation of the current field image data "bd" is judged to be "0" or "255". In case of the "bd" equals to "0", the gradation "0" gives the voltage which is the nearest to a voltage to be the gradation "0", within "one field period". In case of the "bd" equals to "255", the gradation "255" gives the voltage which is the nearest to a voltage to be the gradation "255" within "one field period". Thus, in this case, the current field image data "bd" is output as an output data "out" in step S305.

When the gradation of the current field image data "bd" is neither 0 nor 255, the output data "out" is decided by the data table for quick response. In the present embodiment, a data table for quick response only includes the output data corresponding to eight gradations of current and preceding field image data, therefore an output data "out" corresponding to 256 gradations of current field image data "bd" is calculated by performing linear interpolation. The method of the interpolation is as follows.

In step S306, the comparison of the preceding field image data "kd" and the current field image data "bd" is performed. In the present embodiment, since the current field image data "bd" is converted into the current field image data "jd" employing thresholds used at conversion of the preceding field image data "kd", the preceding field image data "kd" and the current field image data "jd" are compared directly.

As a result of comparison, in case where they are equal, there is no or few change between the current and preceding field image data. Thus, in this case, the current field image data "bd" is output as an output data "out" in step S307.

In case where they are not equal, it must be decided in a step S308, whether the preceding field image data "kd" or the preceding field image data "kd+1" should be used as the preceding field image data "id" at the application of a data table for quick response.

In a case where the current field image data "jd" is smaller than the preceding field image data "kd", the preceding field image data "kd" is assumed to be equal to the preceding field image data "id" in step S309. On the other hand, when the current field image data "jd" is larger than the preceding field image data "kd", the preceding field image data "kd+1" is assumed to be equal to the preceding field image data "id" in step S310. Thus, by determining the preceding field image data "id", it is possible to prevent an overdone acceleration of liquid crystal material so that moderate image between the transparencies of the current and preceding field image data is obtained at the end of "one field period".

With using the preceding field image data "id" determined in steps S309 or S310 and the converted current field image data "jd" which is retrieved in step S303, the output data Td[id][jd] corresponding to them is read out from the data table for quick response. Similarly, the differential data Td_v[id][jd] for interpolation is read out from the differential data table.

The relation between the output data Td [id][jd], the preceding field image data id and non-converted current field image data "bd is shown in FIG. 12. The output data "out" corresponding to the current field image data "bd" can be calculated by multiplying the differential data Td_v [id][jd] for interpolation by the distance between the current field image data "bd" and the output data Td[id][jd] which is calculated with equation "bd-Td_div[jd] ", and adding it to the output data Td[id][jd] as shown in step S311.

In a step S312, the output data "out" is output, and a voltage corresponded to the output data "out" is applied to liquid crystal material in each pixel.

As described above, according to the present embodiment, the data table for quick response and the differential table for interpolation comprise output data and differential data corresponding to eight gradations of the preceding and current field image data respectively, and the differential data is employed to interpolate the output data, thereby downscaling driving circuit with reducing the amount of memory for storing the data tables and the number of data lines for connecting the data tables with a processor. Moreover, load of calculation is decreased by employment of the differential data table so that scale of the driving circuit can be further decreased.

Further, the converted image data, in which the amount of data is reduced by shortening its bit length, is stored into the frame memory, thereby enables to downscale the driving circuit with reducing the size of frame memory and the number of data line for connecting the frame memory with the processor.

Though the preceding field image data, the current field image data and the output data have 256 gradations respectively, and the data table for quick response and the differential data table for interpolation are composed in correspondence to eight gradations of the preceding field image data and current field image data, gradations other than the above is also applicable and reduction of necessary amount of memory and a circuit scale are possible.

Gradations of the converted preceding field image data, i.e. gradations of the preceding field image data on the data tables and in the frame memory, can be determined in consideration of necessary amount of memory, error and necessary amount of calculation at conversion and reconversion.

According to the present invention, a voltage to give desired transparency at the end of the current field is applied to the pixel during the current field, therefore it is possible to obtain LCDs which can achieve high displaying quality for moving image without perceiving after image and blurring.

According to the present invention, a data table for quick response in which the transparency of the preceding field and the desired transparency of the current field are placed in rows and columns, and a voltage to be applied to the liquid crystal material is placed at intersection is employed. Therefore it is possible to achieve the desired transparency at the end of the current field so that LCDs which can achieve high displaying quality for moving image without perceiving lo after image and blurring are obtained.

According to the present invention, it is possible to reduce the amount of memory for storing a data table for quick response and the number of data line for connecting a processor with the data table for quick response, thereby enables to provide a downscaled driving circuit of LCDs which costs reasonable and has high displaying performance for moving image.

According to the present invention, it also possible to reduce the amount of frame memory for storing the preceding field image data and the number of data line for connecting a processor with the frame memory, thereby enables to provide a downscaled driving circuit of LCDs which costs reasonable and has high displaying performance for moving image.

According to the present invention, output data shall be determined from the current and preceding field image data employing differential data for interpolation which is stored in a difference data table, thereby enables to provide a driving circuit of LCDs with high displaying performance for moving image while reducing amount of calculation and scale of a driving circuit.

According to the present invention, the amount of calculation for interpolation can be reduced by equalizing bit length of the preceding field image data and gradations of the preceding field image data in the data table for quick response, thereby enables to provide a downscaled driving circuit of LCDs which costs reasonable and has high displaying performance for moving image.

While there has been described what is at the present considered to be preferred embodiment of the invention, it will be understood that various modifications may be made therein, and it is intended to cover in the appended claims all such modifications as fall within the true spirit and scope of the invention.

What is claimed is:

1. A driving circuit for a LCD, comprising;

a frame memory configured to store and retrieve a current field image data as a preceding field image data after a delay of one field period;

a data table for quick response configured to store output data in correspondence with the current field image data and preceding field image data;

a first processor configured to determine a still image in which the current field image data is output as it is, in case the current field image data is judged to be a still image from the current image field data and the preceding field image data; and a second processor configured to determine an output data through employing the data table for quick response after the current field image data is not judged to be a still image from the current field image data and the preceding field image data.

2. The driving circuit of claim 1, wherein a still image of the current field image data is judged through employing the current field image data conducting data conversion of reducing a same amount of data as the preceding field image data which converts the data of reducing the amount of data.

3. A driving method for driving a LCD, comprising:

determining an output data from preceding field image data and current field image data through employing a data table for quick response that stores output data in correspondence with the preceding field image data and the current field image data; and applying a voltage corresponding to the output data to a pixel to drive liquid crystal material in the pixel, wherein the determining step comprises (1) determining the output data as the current field image data, in case the current field image data is judged to be a still image from the current field image data and preceding field image data, and (2) determining the output data from the current field image data and the preceding field image data, in case the current field image data is not judged to be a still image.

4. A driving method of claim 3, wherein a still image of the current field image data is judged through employing the current field image data conducting data conversion of reducing a same amount of data as the preceding field image data which converts the data of reducing the amount of data.

* * * * *